United States Patent [19]

Hwang

[11] Patent Number: 5,074,602

[45] Date of Patent: Dec. 24, 1991

[54] DOGGING MECHANISM FOR ACTUATOR LEVER

[75] Inventor: Ki-Ho Hwang, Rowland Heights, Calif.

[73] Assignee: Adams Rite Manufacturing Company, City of Industry, Calif.

[21] Appl. No.: 620,100

[22] Filed: Nov. 30, 1990

[51] Int. Cl.[5] ..... E05C 1/14

[52] U.S. Cl. ..... 292/173; 292/150

[58] Field of Search ..... 292/210, 207, 153, 173, 292/150, 92, 21, 144; 70/215

[56] References Cited

U.S. PATENT DOCUMENTS

| | | | |
|---|---|---|---|
| 1,141,338 | 6/1915 | Hill . | |
| 1,161,972 | 11/1915 | Rehfuss . | |
| 2,255,418 | 9/1941 | Fletcher | 70/215 |
| 2,379,810 | 7/1945 | Ledin et al. . | |
| 2,772,905 | 12/1956 | Dusing . | |
| 3,011,330 | 12/1961 | Eads . | |
| 3,011,817 | 12/1961 | Eads . | |
| 3,097,007 | 7/1963 | Eichacker et al. . | |
| 3,214,947 | 11/1965 | Wikkerink . | |
| 3,266,829 | 8/1966 | Gasser et al. . | |
| 3,271,982 | 9/1966 | Welch . | |
| 3,345,099 | 10/1967 | Paul et al. . | |
| 3,368,374 | 2/1968 | Eads . | |
| 3,608,127 | 9/1971 | Lewin . | |
| 3,614,145 | 10/1971 | Zawadski . | |
| 3,663,047 | 5/1972 | Zawadski . | |
| 3,705,739 | 12/1972 | Adler . | |
| 3,811,717 | 5/1974 | Floyd et al. . | |
| 3,866,730 | 2/1975 | Balducci . | |
| 3,869,159 | 3/1975 | Eads . | |
| 3,873,141 | 3/1975 | Peterson . | |
| 4,003,593 | 1/1977 | Wilzig et al. . | |
| 4,007,954 | 2/1977 | Erickson . | |
| 4,012,066 | 3/1977 | Salvatore . | |
| 4,083,590 | 4/1978 | Folger . | |
| 4,095,445 | 6/1978 | Storlie et al. | 70/215 |
| 4,145,900 | 3/1979 | Ohno . | |
| 4,183,565 | 1/1980 | Allemann . | |
| 4,218,903 | 8/1980 | Eads . | |
| 4,311,329 | 1/1982 | Kral . | |
| 4,458,928 | 7/1984 | Hirschbein . | |
| 4,624,490 | 11/1986 | Miller . | |
| 4,641,867 | 2/1987 | Geringer et al. | 292/144 X |
| 4,726,613 | 2/1988 | Foshee . | |
| 4,785,286 | 11/1988 | Martin . | |
| 4,839,988 | 6/1989 | Betts et al. . | |
| 4,968,070 | 11/1990 | Choi . | |

FOREIGN PATENT DOCUMENTS

| | | |
|---|---|---|
| 2441396 | 11/1978 | France . |
| 2447439 | 1/1979 | France . |

*Primary Examiner*—Richard E. Moore

*Attorney, Agent, or Firm*—William W. Haefliger

[57] ABSTRACT

A mechanism actuator comprising a frame; a lever movable to actuate mechanism associated with the frame; a dog movable into and out of blocking relation with lever movement; and structure for selectively holding the dog in either of two positions between which it is movable, the dog in one of the positions blocking lever movement, and the dog in the other of the positions unblocking lever movement.

13 Claims, 4 Drawing Sheets

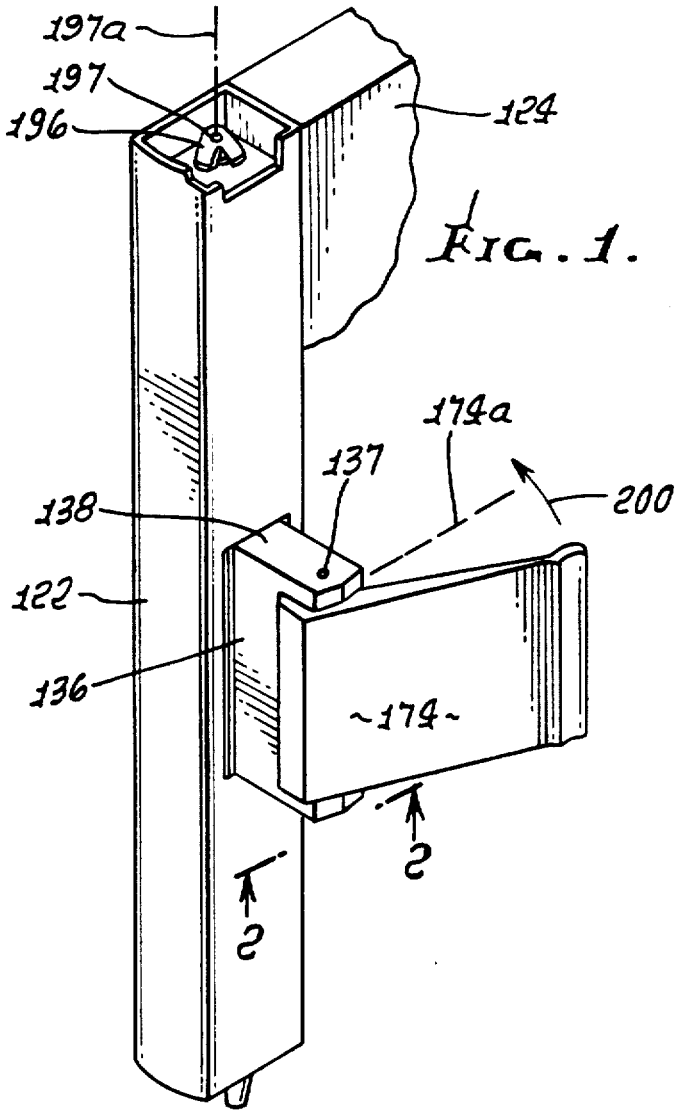
FIG. 1.
FIG. 1a.
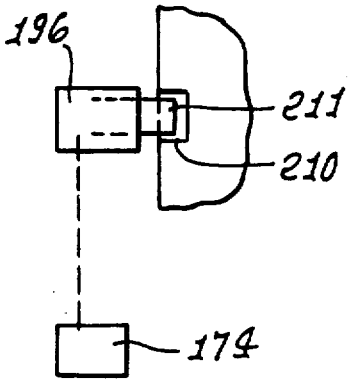
FIG. 2.
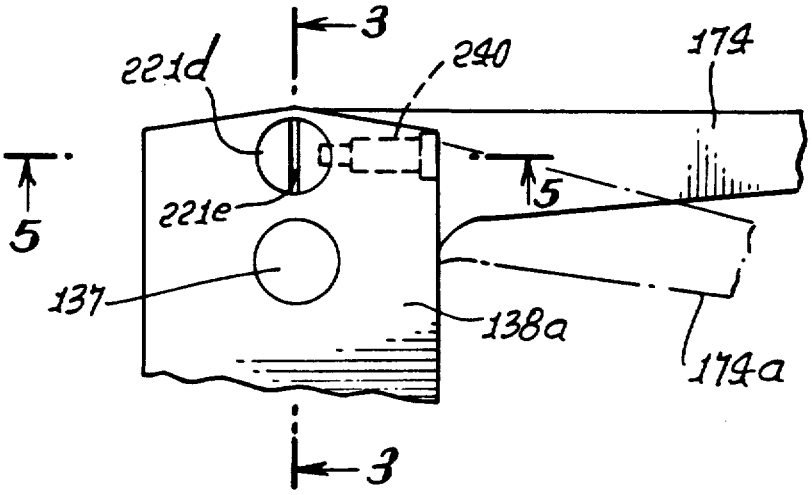

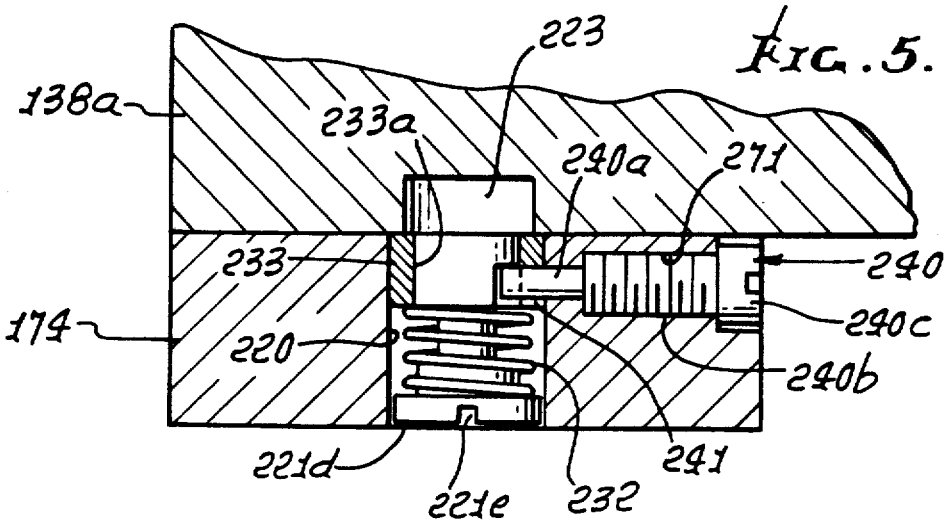
FIG. 5.
FIG. 7.
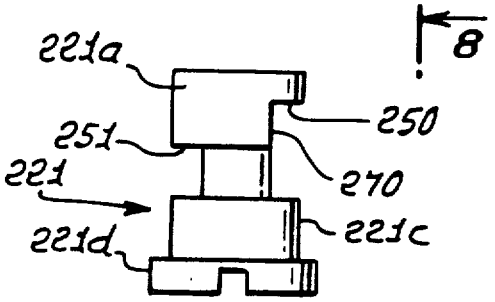
FIG. 9.
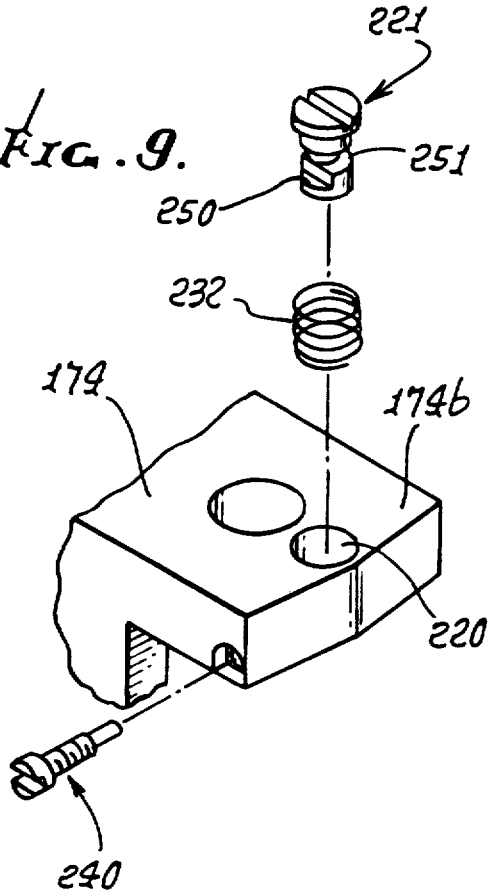
FIG. 8.
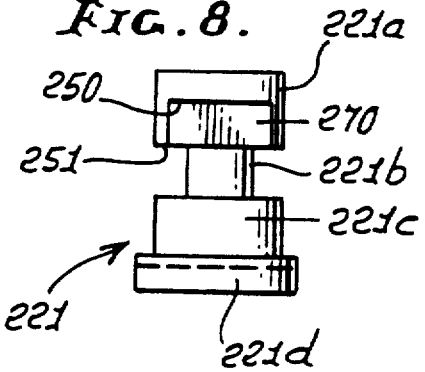

DOGGING MECHANISM FOR ACTUATOR LEVER

BACKGROUND OF THE INVENTION

This invention relates generally to mechanism actuators to effect door or closure latching and unlatching, and more particularly concerns the dogging and undogging of levers or paddles which are movable to operate such mechanism actuators.

U.S. Pat. No. 3,869,159 discloses mechanism by which forces generated by pushing or pulling on a lever or paddle-type actuator is converted into motion for the retraction of a door latch bolt. It is desirable that the lever or paddle at times be held or retained in a position such that the bolt is held retracted from the latch, so that the door may be opened or closed without need for bolt latching. Accordingly, there is need for means to impart this optional, additional function to a paddle or lever of the type referred to.

SUMMARY OF THE INVENTION

It is a major object of the invention to provide a simple, effective means, as referred to, which will allow optional retention of the paddle or bolt in a position allowing opening or closing of the door or closure, without latching, i.e., will hold a latching bolt in unlatched position.

Basically, the invention is embodied in a mechanism actuator comprising, in combination, a) a frame, b) a lever movable to actuate mechanism associated with the frame, c) a dog movable into and out of blocking relation with lever movement, d) and means for selectively holding the dog in either of two positions between which it is movable, the dog in one of the positions blocking lever movement, and the dog in the other of the positions unblocking lever movement.

As referred to, the mechanism may typically include door latching and unlatching structure operatively connected to the lever or paddle.

It is another object of the invention to provide dog holding means in the form of a retainer pin, the dog having spindle form with an axis and being adjustably movable axially between the two positions, and the dog also having two shoulders one of which is rotatable with the dog into engagement with the pin when the dog is in one of its axial positions, and the other shoulder rotatable with the dog into engagement with the pin when the dog is in the other of its axial positions.

Typically, the two shoulders are spaced apart in an axial direction and also angularly offset about the axis.

Yet another object is to provide a spring urging the dog axially away from blocking relation with lever movement. The lever itself may have hinged connection to the frame, as will be seen. The lever may define a bore in which the dog is axially movable and also is rotatable, the dog being generally cylindrical, the frame defining a recess into which the dog is movable to block lever pivoting; and the spring may be retained in that bore.

A further object is to provide the pin in the form of a set screw having a threaded shank, the set screw having one position in which it projects into the path of dog movement in the bore, as via a thrust bearing, and the pin being rotatable to retract from the bore.

These and other objects and advantages of the invention, as well as the details of an illustrative embodiment, will be more fully understood from the following specification and drawings, in which:

DRAWING DESCRIPTION

FIG. 1 is a perspective view of a lever mounted on a frame, to be pivoted relative to the frame, and optionally dogged so as to be prevented from such pivoting;

FIG. 1*a* is a schematic diagram;

FIG. 2 is an enlarged end view taken on lines 2—2 of FIG. 1;

FIG. 5 is a section taken at right angles to FIG. 3, showing a retainer pin structure;

FIG. 7 is a side elevation showing the dogging spindle as seen in FIG. 5;

FIG. 8 is a side elevation taken on lines 8—8 of FIG. 7;

FIG. 9 is a perspective, exploded view showing paddle or lever structure with the pin and a spring;

DETAILED DESCRIPTION

Figure 10:
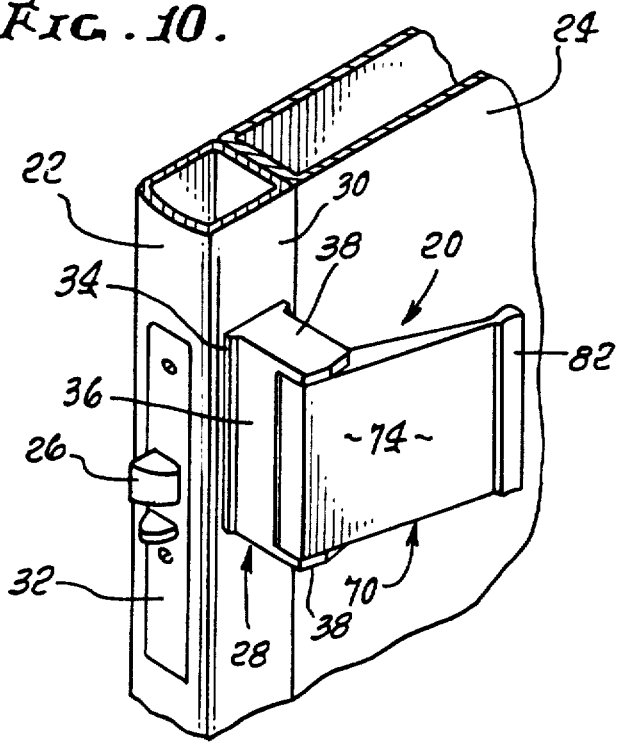
FIG. 10 is a view like FIG. 1 but showing a prior apparatus.
Figure 12:
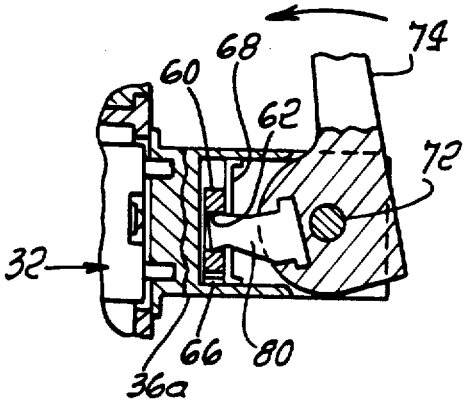
FIG. 12 is another section taken through the FIG. 10 apparatus showing the position of the paddle operator or lever after it has been pushed inwardly to actuate the latch.
Figure 11:
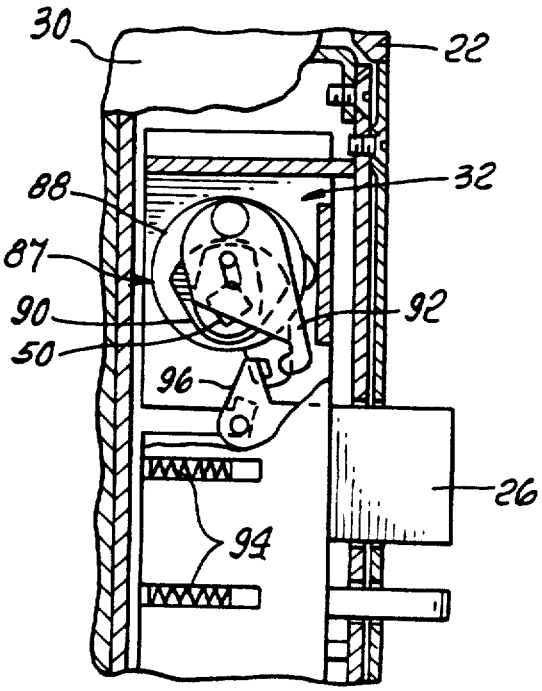
FIG. 11 is a section through the FIG. 10 apparatus showing the manner in which a latch operator is coupled to a latch and showing the latch at rest with the bolt extended.
Figure 13:
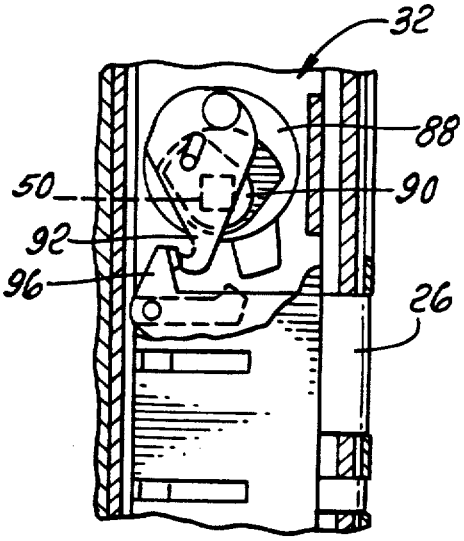
FIG. 13 is a view like FIG. 11 showing bolt retracting mechanism in bolt retracting position.

Referring first to FIGS. 10–13, and as described in U.S. Pat. No. 3,869,159, a paddle or lever 74 is pivoted at 72 to structures 28, 36 and 38 on a nose 22 of hinged door 24. A pushing force on the paddle 74 in the direction of the arrow in FIG. 12 will cause the component parts of the device to move from positions as seen in FIG. 11 to positions as seen in FIGS. 12 and 13. The pushing force will cause the extremity of driving ear 80, which is disposed within slot 62 of driving plate 60, to move downwardly, as viewed in FIG. 12. This, in turn, moves the driving plate 60 downwardly against the urging of spring or springs 66. This movement of driving plate downwardly in FIG. 12 will cause clockwise rotational movement of the spindle assembly, including spindle 50, into the position shown in FIG. 13; and such rotational movement of the spindle will actuate the latch so as to cause lever element 92 to move arm 96 and bolt 26 into the retracted position.

With the bolt thus retracted, the door can, of course, be swung inwardly into the room or building. When the paddle operator is released, springs 66 will urge the driving plate and the paddle operator back into at-rest configuration shown in FIG. 10. Other numbered elements as shown are described in U.S. Pat. No. 3,869,159.

The problem with the FIGS. 10-14 apparatus is that there is no way to permit the door to swing freely without exerting pushing force on the paddle or lever 74.

Referring now to FIGS. 1-9, the improved apparatus includes a lever 174 pivotally attached at 137 to a door frame part 122, as via structures 136 and 138. See also door 124. Corresponding elements are seen in FIG. 10.

The lever is movable, as in the direction of arrow 200, to actuate mechanism associated with the frame. Such mechanism may, for example, take the form of that seen in FIGS. 10-13, and as referred to above, there being spring means to bias the lever or paddle 174 back toward FIG. 1, as in FIG. 12, for example. The mechanism shown in FIG. 1, to be rotated by the lever, is mounted on a shaft 197 having an axis 197*a*, as seen at 196. It typically causes a door locking bolt to be retracted as the lever moves in direction 200, or causes the bolt to be extended as the lever moves back to position seen in FIG. 1.

In accordance with the present invention, a dog is carried to be movable into and out of blocking relation with lever movement; and means is provided for selectively holding the dog in either of two positions between which it is movable, the dog in one of its positions blocking lever movement, and the dog in the other of the positions unblocking lever movement.

As will be seen, the dog may be carried to block lever return movement back to FIG. 1 solid line position from an advanced position indicated by broken line 174*a*. Note that in 174*a* position, the lever has rotatably operated the mechanism 196 to retract the bolt from door latching position, so that the door may then swing freely, as for example relative to a keeper indicated at 210 in FIG. 1*a*. That figure schematically shows a bolt 211 advanced by mechanism 196 into keeper 210.

More specifically, and as seen in FIGS. 2-9, the lever end portion 174*b* defines a bore 220 in which the dog 221 is axially movable (see axis 222), the dog also being rotatable about axis 222.

Figure 3:
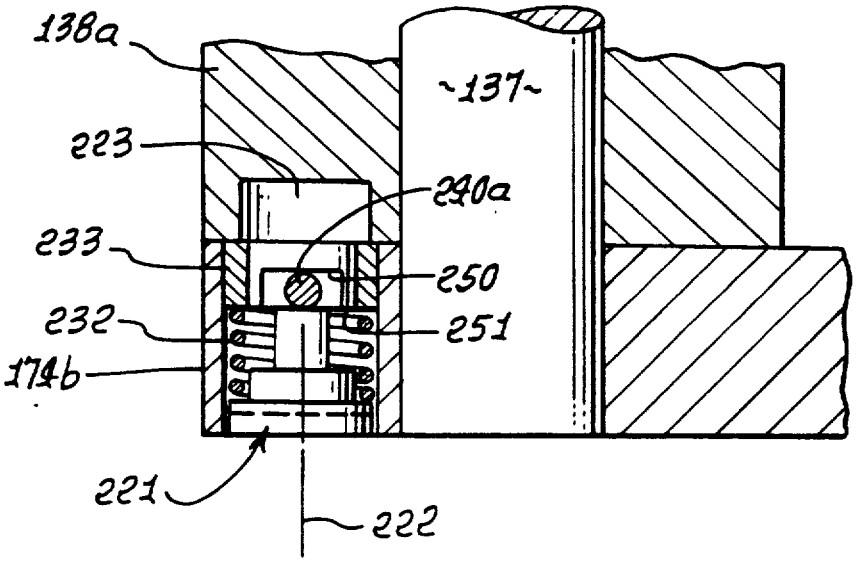
FIG. 3 is an enlarged sectional view taken on lines 3—3 of FIG. 2, and showing the lever in undogged condition, relative to a dogging spindle.
Figure 4:
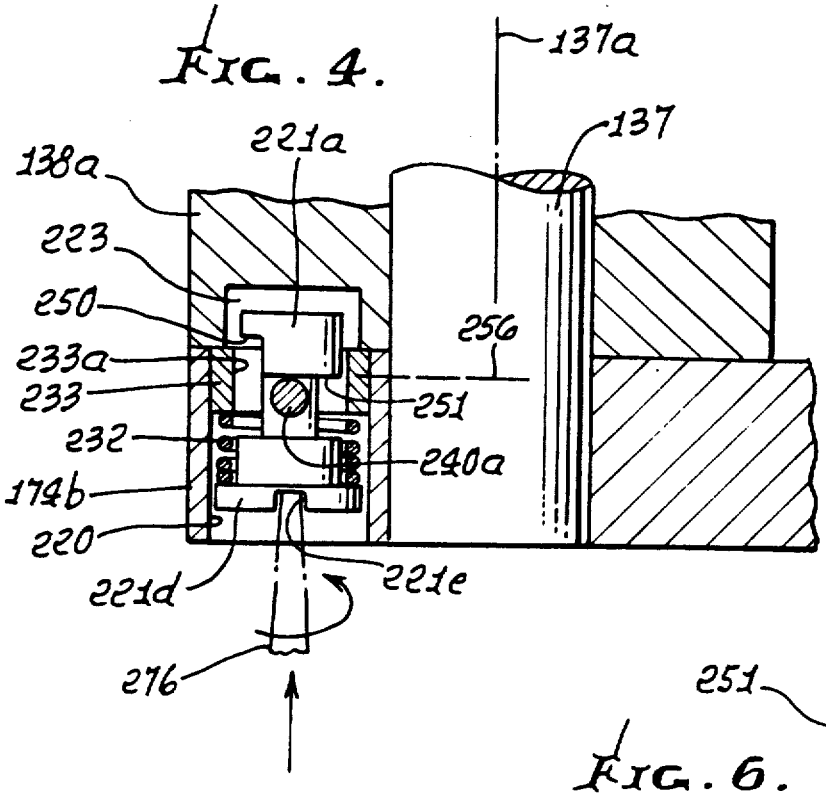
FIG. 4 is a view like FIG. 3 showing the lever in dogged condition, relative to a dogging spindle.
Figure 6:
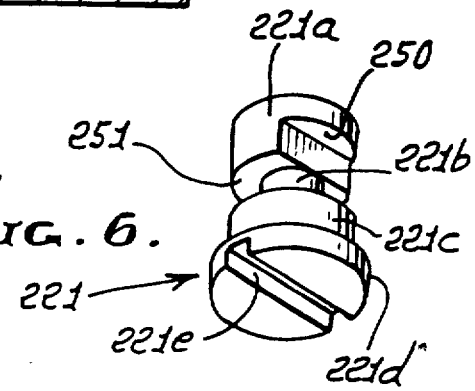
FIG. 6 is a perspective view showing the dogging spindle of FIGS. 3–5.

FIG. 3 shows the dog 221 retracted from a recess 223 in frame part 138*a*, whereas in FIG. 4 the dog upper portion 221*a* is upwardly advanced into recess 223 to block lever rotation relative to frame part 138*a*. The axis of lever rotation appears at 137*a*.

The generally cylindrical dog 221 has an enlarged diameter upper portion 221*a*, a reduced diameter middle portion 221*b*, an enlarged diameter lower portion 221*c*, and a lowermost head 221*d*. As seen in FIG. 5, the diameter of the circular head 221*d* is slightly less than the diameter of the bore 220.

A spring is provided to urge the dog axially away from blocking relation with lever movement; and, in the example shown, a compression spring 232 is fitted between the top of head 221*d* and the lower end of an annular insert 233 received in bore 220 to urge the dog downwardly. The top of that insert slides against the underside of the frame part 138*a*, as the lever swings relative to 13B*a*. Thus, insert 233 serves as a thrust bearing. At the same time, the bore 233*a* of the insert serves as a guide for guiding axial movement of the dog upper portion 221*a*, as is clear from FIGS. 3-5.

The means to selectively hold the dog in either of its two positions, as seen in FIGS. 3 and 4, includes a retainer pin 240 having a reduced diameter forward end 240*a* projecting sidewardly into bore 220, and through the wall of the insert, as at 241, to project into the path of dog up and down movement. See FIG. 5. As also shown, the dog has two shoulders, one of which is rotatable with the dog about the axis into engagement with the pin when the dog is in on of the axial positions, and the other shoulder rotatable with the dog into engagement with the pin when the dog is in the other of the axial positions. Such shoulders are shown, for example, at 250 and 251. Shoulder 250 may be formed by milling the dog portion 251*a*, as at 270.

As shown in FIG. 3, the dog has been rotated to one angular position $\alpha$ about axis 222 in which the dog drops axially down into one position as urged by spring 232, so that shoulder 250 engages the pin forward end 240*a*. In this position, the lever is undogged relative to the frame part 138*a*, so that it may be moved between the positions seen in FIG. 1, retracting the bolt from the latch when the lever is pushed forwardly (see arrow 200).

As seen in FIG. 4, the dog has been pushed axially upwardly (against tension exerted by the spring) so that the shoulder 251 comes into the horizontal plane 256 defined by the top of pin forward portion 240*a*; and the dog is rotated to another angular position $\beta$ about axis 222, in which the shoulder 251 engages the top of 240*a*, holding the dog in elevated position, as seen in FIG. 4. The lever is then dogged, as referred to above.

It will be noted that the shoulders 250 and 251 are spaced apart in the direction of axis 222, and also axis 137*a*; and they are also angularly offset about axis 222. See FIGS. 6-8. Typically, $\beta$ is equal to about $\alpha \pm 90°$.

Pin 240 is typically a set screw having a shank 240*b* in threaded engagement with a threaded bore 271 in the lever. The screw has a head 240*c* exposed for rotation to back out the screw end 240*a* from bore 220, allowing removal of the dog 221, spring 232 and insert 233. The head 221*d* of the dog may be grooved at 221*e* to allow dog rotation, as described, by means of a tool 276.

I claim:

1. In a mechanism actuator, the combination comprising:
   a) a frame,
   b) a lever movable to actuate mechanism associated with the frame,
   c) a dog movable into and out of blocking relation with lever movement,
   d) and means including a retainer for selectively holding the dog in either of two positions between which it is movable, the dog in one of the said positions blocking lever movement, and the dog in the other of said positions unblocking lever movement,
   e) the dog having an axis and being adjustably movable axially between said two positions,
   f) the dog also having two shoulders, one of which is rotatable with the dog about said axis into engagement with said retainer when the dog is in one of said axial positions, and the other shoulder rotatable with the dog into engagement with the retainer when the dog is in the other of said axial positions.

2. The combination of claim 1 including said mechanism.

3. The combination of claim 2 wherein said mechanism includes door latching and unlatching structure, operatively connected to the lever.

4. In a mechanism actuator, the combination comprising:
   a) a frame,
   b) a lever movable to actuate mechanism associated with the frame, c) a dog movable into and out of blocking relation with lever movement, d) and means for selectively holding the dog in either of two positions between which it is movable, the dog in one of said positions blocking lever movement, and the dog in the other of said positions unblocking lever movement, e) said means including a retainer pin, the dog having spindle form with an axis and being adjustably movable axially between said two positions, and the dog also having two shoulders, one of which is rotatable with the dog about said axis into engagement with said pin when the dog is in one of said axial positions, and the other shoulder rotatable with the dog into engagement with the pin when the dog is in the other of said axial positions.

5. The combination of claim 4 wherein said two shoulders are spaced apart in an axial direction and also angularly offset about said axis.

6. The combination of claim 4 including a spring urging the dog axially away from blocking relation with lever movement.

7. The combination of claim 6 wherein the lever has hinged connection to the frame.

8. The combination of claim 6 wherein the lever defines a bore in which the dog is axially movable and also is rotatable, the dog being generally cylindrical, the frame defining a recess into which the dog is movable to block lever pivoting.

9. The combination of claim 8 wherein said spring is retained in said bore.

10. The combination of claim 4 wherein said pin extends in said lever normal to the direction of dog axial movement, and is accessible for pin axial adjustment.

11. The combination of claim 10 wherein said pin is a set screw having a threaded shank, the set screw having one position in which it projects into said bore, and the pin being rotatable to retract from said bore.

12. The combination of claim 4 wherein the dog has a first end portion defining said shoulders, a guide portion, and a head which is engaged by a tool to displace the dog axially and to also rotate the dog.

13. The combination of claim 8 including a tubular insert in said bore, and slidable against the frame, the dog movable axially in said insert, the pin projecting through a through-opening in the side of the insert and into position for seating one or the other of the said shoulders.

* * * * *